US009980540B2

(12) United States Patent
Kita

(10) Patent No.: US 9,980,540 B2
(45) Date of Patent: May 29, 2018

(54) BLUETOOTH ENABLED JEWELRY

(71) Applicant: Kristy Kita, Austin, TX (US)

(72) Inventor: Kristy Kita, Austin, TX (US)

(73) Assignee: Kristy Kita, Round Rock, TX (US)

( * ) Notice: Subject to any disclaimer, the term of this patent is extended or adjusted under 35 U.S.C. 154(b) by 0 days. days.

(21) Appl. No.: 14/984,643

(22) Filed: Dec. 30, 2015

(65) Prior Publication Data

US 2017/0079388 A1 Mar. 23, 2017

Related U.S. Application Data

(60) Provisional application No. 62/098,796, filed on Dec. 31, 2014.

(51) Int. Cl.
*A44C 7/00* (2006.01)
*A44C 13/00* (2006.01)

(52) U.S. Cl.
CPC ..... *A44C 7/009* (2013.01); *A44C 13/00* (2013.01)

(58) Field of Classification Search
CPC ..... A44C 7/00; A44C 7/002; A44C 7/004; A44C 7/009; A44C 13/00; A44C 15/0025; A44C 15/00; A44C 15/003; H04R 1/105; H04R 1/1091; H04R 1/10
See application file for complete search history.

(56) References Cited

U.S. PATENT DOCUMENTS 2,409,369 A * 10/1946 Lo Curto ..... A44C 7/009 63/14.2
7,980,095 B1 * 7/2011 Masterson ..... A44C 11/002 63/3.1
2002/0090104 A1 * 7/2002 Ma ..... H04R 1/1091 381/374
2009/0034774 A1 * 2/2009 Lowry, Jr. ..... H04R 1/1091 381/380
2013/0287241 A1 * 10/2013 Prelogar ..... H04R 1/105 381/381
2014/0098983 A1 * 4/2014 Clow ..... H04R 1/1091 381/375

FOREIGN PATENT DOCUMENTS

FR 2915660 A1 * 11/2008 ..... A44C 7/009

* cited by examiner

*Primary Examiner* — Jack W Lavinder
(74) *Attorney, Agent, or Firm* — Pham IP Group; Frank Pham

(57) ABSTRACT

The preferred embodiment is directed to a method and apparatus of a bluetooth that is enabled in a jewelry device for use on bluetooth headset earpieces. The preferred embodiment can be provided in the shape of almost any objects. Envisioned objects include pearls, crystals, feathers, and diamonds, among similar items. The preferred embodiment increases consumer purchase appeal to meet a need of a wearable technology jewelry and bluetooth. The accessories that can be applied and removed from the present preferred embodiment can be done without the use of additional tools.

11 Claims, 4 Drawing Sheets

BLUETOOTH ENABLED JEWELRY

BACKGROUND

1. Field of the Preferred Embodiment

The preferred embodiment generally relates to phone earpiece accessories. More specifically, the preferred embodiment is a Bluetooth enabled jewelry method and apparatus for the use of Bluetooth headset earpieces.

2. Background Art

People have grown accustomed to the convenience afforded by wireless or cellular telephones. Just about everyone, including young children, carries one on their person, or knows where they can get their hands on one at times. To further the functionality of such phones, manufacturers have added the ability to add a wireless headset by use of a Bluetooth connection. Such earpieces or headsets allow users the ability to talk without having to hold the phone to their ears for long periods of time. In fact, such aesthetic appealing earpieces meet the requirements for hands free usage in motor vehicles required in many states in the U.S. for safe driving. However, the appearance of such earpieces is often dull, boring, and excessively high tech.

While the market has responded with cell phone cases and covers that allow the user to customize their cell phone to their personality, it has not responded to further the opportunity with the same functionality for earpiece devices. Accordingly, there exists a need for a means by which the Bluetooth earpieces can be provided with decorative covers. The development of the Bluetooth enabled jewelry is very much need, and could also create safety and comfort for users.

Likewise, the analyzer from one collection system may not be compatible with another vendor nor is the method for collecting sensory output parameters. A need exists in the art for a method and an apparatus for recreating machine operation parameters collected from varying collection systems to the same characteristics of collected machine operation parameters, so that others may use them to monitor and evaluate the machine operations.

SUMMARY

In a preferred embodiment, the apparatus includes a generally flat, decorative element that is about 3 inches long and about 1.41 inch wide in its preferred embodiment. Such an element attaches the lower outer surface of the earpiece, and would be available in multiple shapes and styles to fit most makes and models of Bluetooth headsets.

In another preferred embodiment, the apparatus can be worn by a user without Bluetooth technologies, allowing the ear cuff component to be worn by itself by the user as jewelry. This piece then provides provisions of attaching various decorative elements.

These pieces are envisioned to be provided with gold, platinum, silver, or rose gold plating, and would be in the shape of pearls, crystals, feathers, and/or diamonds based on the user's preference. It is envisioned that the invention would not interfere with normal operating controls or switches as provided on the headset. The preferred embodiment would be easy to apply and remove from the headset, and allows the user to customize the appearance of the headset on a daily or even hourly basis if desired. The use of the Bluetooth enabled jewelry will find favor with young consumers who desire the wearable technology of electronics and jewelry, and who desire further driving consumer demand for the latest in electronic consumer products.

In its preferred embodiment, the materials required to produce the Bluetooth enabled jewelry are all readily available, and well known to manufacturers of goods of this type. The decorative cover can be made of plastic, metal, copper, or silver. A plastic will only be the "C" shaped section where the Bluetooth earpiece is attached in an injection molding process. Such a process would require the design and use of custom molds. The remaining components of the invention namely the decorative elements, jewels, adhesive, and the like, would best be procured from wholesalers and manufacturers that deal in goods of that nature and assembled at a final location. The relatively simple design of the invention and the material of construction make the Bluetooth enabled jewelry a cost effective design due to the relatively low material and labor costs involved.

Final production of the Bluetooth enabled jewelry will be performed by manufacturing workers of average skill. The materials used in the preferred embodiment are known to the industrial community, and are readily available at a reasonable cost. The-Bluetooth enabled jewelry can be manufactured by existing methods of production including plastic injection molding, mechanical device assembly methods, and mass production technologies. There are sufficient companies throughout the industrialized nations capable of performing the manufacturing process. Although development still remains which could alter the final production design, the above is my considered opinion as of this date.

DETAILED DESCRIPTION

All illustrations of the drawings are for the purpose of describing selected versions of the preferred embodiment and are not intended to limit the scope of the preferred embodiment.

Figure 1:
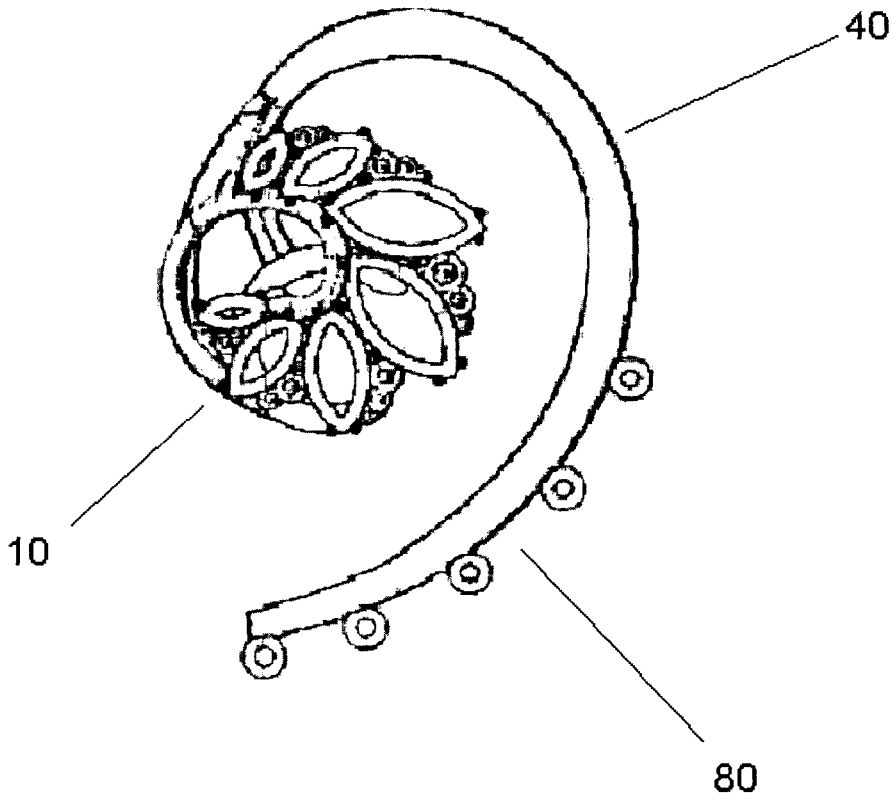
FIG. 1 is a front view drawing of the preferred embodiment.

Referring to FIG. 1, the Bluetooth enabled jewelry includes interchangeable jewelry segments 10 and 80, and a base jewelry segment 40. It should be noted that the preferred embodiment refers to the structure of the male and female interchangeable mechanisms, 50 and 20, 60 and 40 respectively, and the main body of the segment, which together allow for interchangeability.

Figure 2:
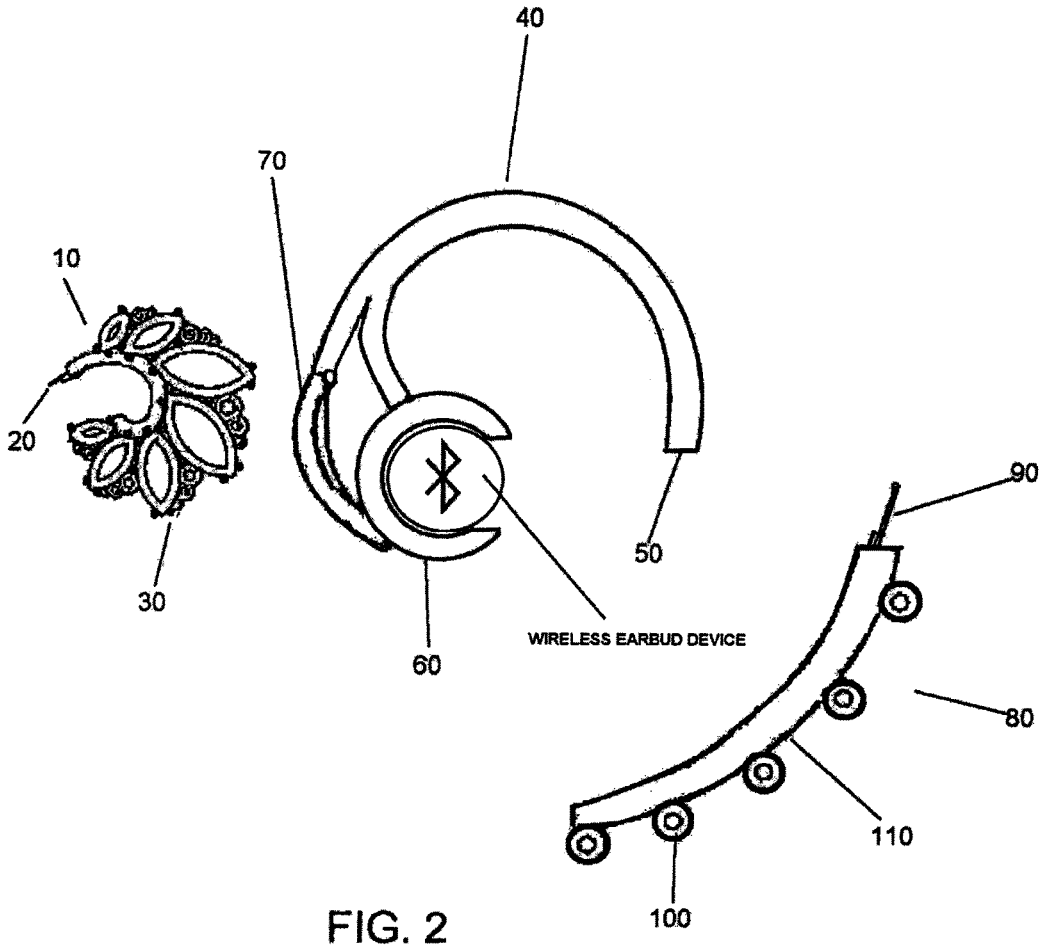
FIG. 2 is a perspective view drawing of the preferred embodiment with its components.

Referring now to FIG. 2, the interchangeable jewelry segment 10 preferably comprises a custom jewelry design 30 and a male mechanism 20 attached to the base jewelry segment 40 at the female mechanism 70. In this embodiment, the custom jewelry design 30 comprises any size, shape, color, material, or combinations thereof which are preferably used to form aesthetically pleasing jewelry and ornamentation. The interchangeable jewelry 10 is interchangeably positionable by a user to form virtually any type of jewelry.

As illustrating in FIG. 2, the base jewelry segment 40 comprises female mechanisms 50 and 70 and a typical earring hook 60. The earring hook 60 is slightly wider at the bottom end and taper up from the end. To enable the Bluetooth audio device, the removable and passive attachment means of open end grommets are sized to meet resistance at the wider end (bottom) of the earring hook 60. The Bluetooth audio device slides through and is carried by the passive attachment means to the wider end of the earring hook 60 and is secured by the resistance.

Still referring FIG. 2, the interchangeable jewelry segment 80 preferably comprises any size, shape, color, material, or combinations thereof which are preferably used to form aesthetically pleasing jewelry and ornamentation. The interchangeable jewelry segment 80 preferably comprises one or more beads 100 preferably attached together on a hoop 110 as illustrated in FIG. 2 and a male mechanism 90 preferably attached to the base jewelry segment 40 at the female mechanism 50. The hoop 110 most preferably comprises at least one bead 100. As those skilled in the art will readily recognize upon studying this application, beads 100 can comprise numerous dimensions and/or shapes while still achieving desirable results. The hoop 110 can optionally contain decorative elements or inscriptions.

One or more custom beads 100 can optionally be placed onto the hoop 110, which can be virtually any length, allowing multiple combinations of custom beads 100 to be provided in numerous sizes and shapes, to form any type of jewelry.

Figure 3:
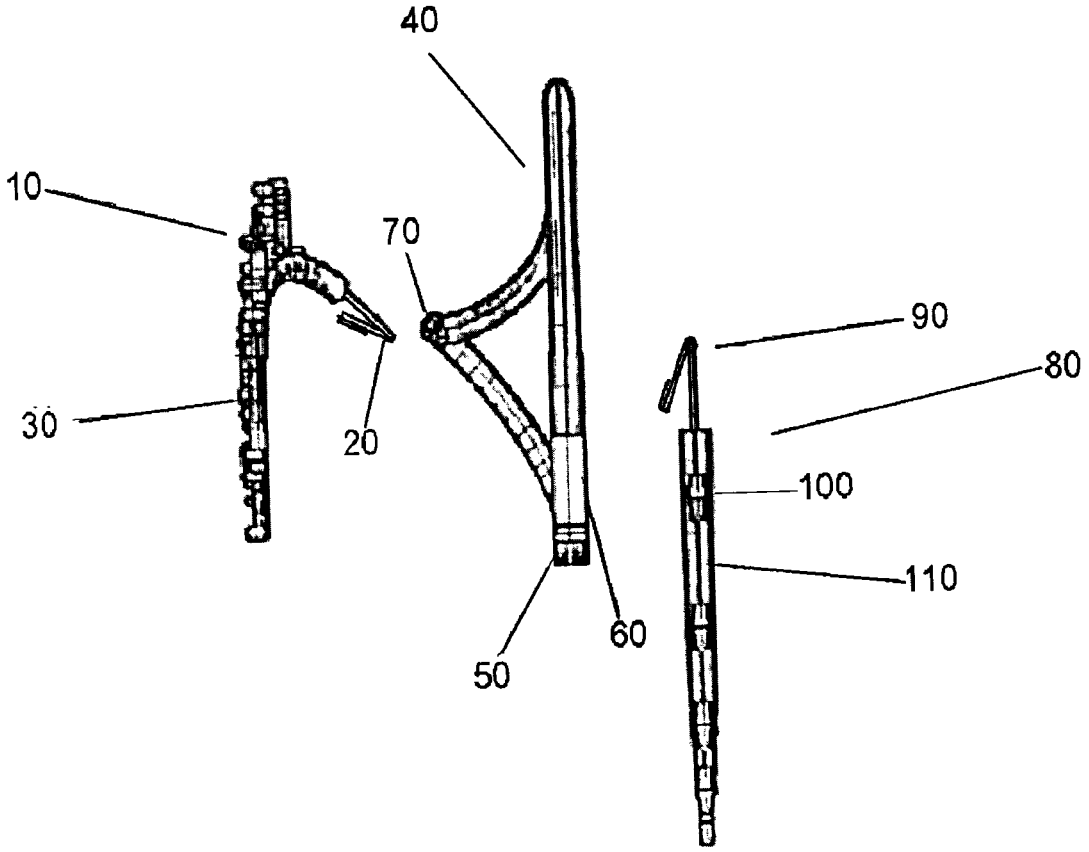
FIG. 3 is a side view drawing of the preferred embodiment with its components.

As seen in FIG. 3, the present preferred embodiment consists of a male/female coupling attachment for the interchangeable jewelry segment 10 and 80. To secure the interchangeable jewelry segment 10 to the base jewelry segment 40, the male mechanism 20 is clasped by box clasp 120 through the female mechanism 70 on the base jewelry segment 40 to interconnect the interchangeable jewelry segment 10 and the base jewelry segment 40.

Still referring FIG. 3, the male mechanism 90 and the female mechanism 50 are used to interconnect the interchangeable jewelry segment 80 to the base jewelry segment 40 to form an earring assemblage as desire by the user.

Figure 4:
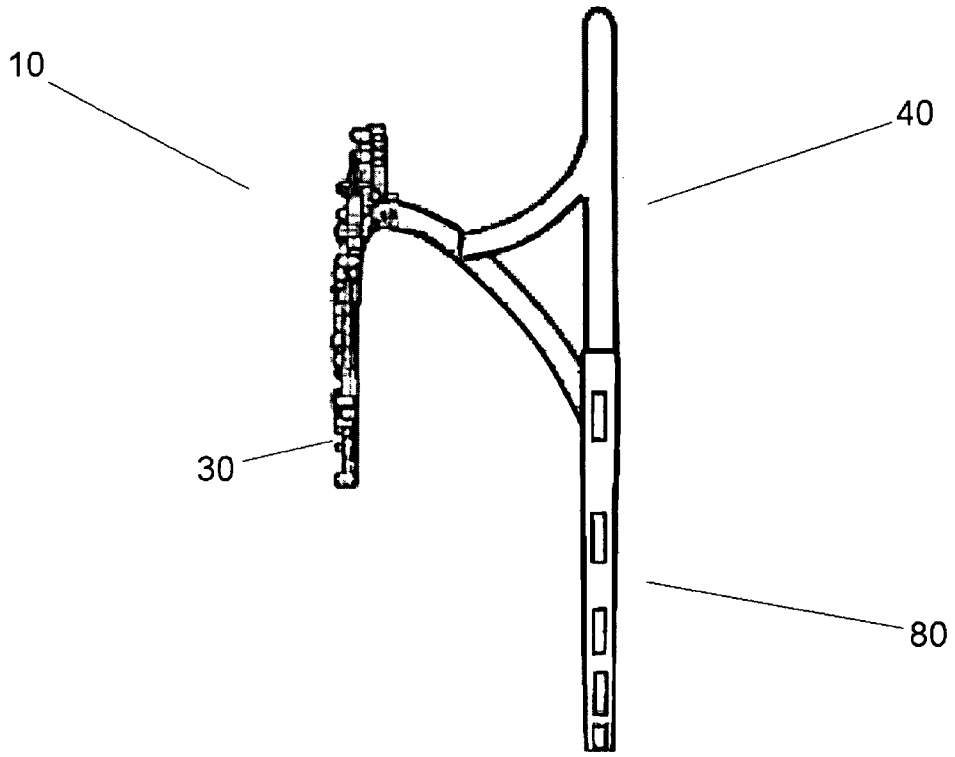
FIG. 4 is a side view drawing of the preferred embodiment.

As shown in FIG. 4, the preferred embodiment consists of the interchangeable jewelry segments 10 and 80 attached to the base jewelry segment 40 to construct the Bluetooth enabled jewelry. Jewelry custom designs can be virtually unlimited in terms of optional looks, materials, and configurations through the present invention. The earpiece hook of the present invention attaches to the earbud conventionally by either of the two universal methods.

While the preferred embodiment has been described in terms of several embodiments, it will be apparent to those skilled in the art that various changes can be made to the described embodiments without departing from the scope of the preferred embodiment as set forth in the following claims.

What is claimed is:

1. An apparatus comprising a wireless earbud and interconnected jewelry system, said apparatus comprising:

a base jewelry segment being removably attachable to said wireless earbud;

a plurality of interchangeable jewelry segments being removably attachable to said base jewelry segment; and a plurality of fastener coupling mechanisms for securing said plurality of interchangeable jewelry segments to said base jewelry segment.

2. The apparatus of claim 1 wherein said base jewelry segment comprises at least one female mechanism.

3. The apparatus of claim 1 wherein each interchangeable jewelry segment comprises a male mechanism being removably connected to said base jewelry segment via said female mechanism.

4. The apparatus of claim 3 wherein the male mechanism is composed of a barrel clasp.

5. The apparatus of claim 4 wherein the barrel clasp is of a shape to fit into the female mechanism and having within it without falling through.

6. The apparatus of claim 1 wherein said plurality of fastener coupling mechanisms is selected from a group consisting of corkscrew tension, screw, hook, magnetic, springing, slide lock, snap lock, or any combination thereof.

7. The apparatus of claim 1 wherein said plurality of fastener coupling mechanisms is visually concealed.

8. The apparatus of claim 1 wherein each jewelry segment further comprises at least one interchangeable and customizable jewelry design.

9. The apparatus of claim 8 wherein said interchangeable and customizable jewelry design comprises a variety of sizes, shapes, colors, materials, or combinations thereof to form aesthetically jewelry and ornamentation.

10. The apparatus of claim 1, wherein said plurality of fastener coupling mechanisms further comprising:

at least one female mechanism; and at least one male mechanism wherein said male mechanism is clasped through said female mechanism for securing said plurality of interchangeable jewelry segments to said base jewelry segment.

11. A method for combining a wireless earbud and an interconnected jewelry system said method comprising:

a. gathering at least three jewelry segments provided that at least one is a jewelry base segment that allows direct or indirect connection to the human ear;

b. connecting said plurality of interchangeable jewelry segments to said jewelry base segment via said plurality of fastener coupling mechanisms;

c. closing and securing said plurality of interchangeable jewelry segments into said jewelry base segments via said plurality of fastener coupling mechanisms.

* * * * *